US008955707B2

(12) United States Patent
Lim

(10) Patent No.: US 8,955,707 B2
(45) Date of Patent: Feb. 17, 2015

(54) PORTABLE TRIPLE CONTAINER

(76) Inventor: Jin-kwang Lim, Seoul (KR)

( * ) Notice: Subject to any disclaimer, the term of this patent is extended or adjusted under 35 U.S.C. 154(b) by 0 days.

(21) Appl. No.: 14/126,679

(22) PCT Filed: Jun. 18, 2012

(86) PCT No.: PCT/KR2012/004823
§ 371 (c)(1),
(2), (4) Date: Dec. 26, 2013

(87) PCT Pub. No.: WO2012/173462
PCT Pub. Date: Dec. 20, 2012

(65) Prior Publication Data

US 2014/0131366 A1 May 15, 2014

(30) Foreign Application Priority Data

Jun. 16, 2011 (KR) ..... 10-2011-0058335

(51) Int. Cl.
*B65D 81/32* (2006.01)
*B65D 83/00* (2006.01)
*A45C 11/20* (2006.01)

(52) U.S. Cl.
CPC ..... *B65D 81/3216* (2013.01); *B65D 83/0027* (2013.01); *A45C 11/20* (2013.01)
USPC ..... 220/592.03

(58) Field of Classification Search
CPC ..... B65D 83/08; B65D 85/36; B65D 51/28; B65D 25/04; B65D 1/04; B65D 83/00; B65D 85/50; B65D 81/3216; B65D 83/0027; A47G 19/2255; A47G 19/2205; A45C 11/00
USPC ..... 220/592.03, 592.17, 506, 504, 23.89, 220/23.86
IPC ..... B65D 83/76,8/04
See application file for complete search history.

(56) References Cited

U.S. PATENT DOCUMENTS 1,453,676 A * 5/1923 Horan ..... 206/216
2,549,114 A * 4/1951 Mosher et al. ..... 232/43.2
(Continued)

FOREIGN PATENT DOCUMENTS

JP 11-278597 A 10/1999
JP 2001-186922 A 7/2001
(Continued)

OTHER PUBLICATIONS

International Search Report for International Application No. PCT/KR2012/004823.

*Primary Examiner* — Robert J Hicks
(74) *Attorney, Agent, or Firm* — LRK Patent Law Firm

(57) ABSTRACT

A portable triple container is provided, which enables food and beverages to be separately accommodated therein, thereby enabling convenient carrying and storage during an outdoor activity. The present invention implements a novel triple container in which two separate spaces are formed so as to enable the food and beverages to be separately accommodated in the container, and which also enables the food to be extracted and consumed through a simple operation. Thus, the food and beverages may be simply and conveniently carried and stored, and may be extracted without using an additional utensil so as to be conveniently consumed. The portable triple container is configured such that an operation cap part arranged at the bottom of the container may be selectively fixed so as to not only restrict the rotation structure of an inner case according to need but also to ensure that the container is airtight.

10 Claims, 6 Drawing Sheets

(56) References Cited

U.S. PATENT DOCUMENTS

| | | | | |
|---|---|---|---|---|
| 3,815,787 | A * | 6/1974 | Spies | 222/95 |
| 7,140,518 | B2 * | 11/2006 | Wang | 222/390 |
| 2006/0201963 | A1 * | 9/2006 | Sines et al. | 221/279 |
| 2009/0191316 | A1 * | 7/2009 | Perry et al. | 426/115 |
| 2011/0168581 | A1 * | 7/2011 | Williams | 206/216 |
| 2013/0313258 | A1 * | 11/2013 | Sines | 220/288 |

FOREIGN PATENT DOCUMENTS

| | | | | |
|---|---|---|---|---|
| KR | 20-0314352 | Y1 | 5/2003 | |
| KR | 20-0315319 | Y1 | 6/2003 | |
| KR | 20-0360697 | Y1 | 9/2004 | |
| KR | 10-0963159 | B1 | 6/2010 | |
| RU | 2157779 | C1 * | 10/2000 | B65D 83/04 |
| WO | 2009-108378 | A2 | 9/2009 | |

* cited by examiner

PORTABLE TRIPLE CONTAINER

TECHNICAL FIELD

The present invention relates, in general, to a portable triple container and, more particularly, to a portable triple container which enables food and beverages to be separately accommodated therein, thereby enabling convenient carrying and storage during an outdoor activity.

BACKGROUND ART

Generally, a person brings various kinds of foods, beverages, etc. in order to alleviate his or her hunger or quench his or her thirst when enjoying an outdoor activity such as climbing or jogging or an outdoor activity being accompanied by children who drink fluids frequently.

For the outdoor activity, he or she carries food or a beverage in a state of putting it in a separate water bottle or container before leaving for the outdoors, but since it is inconvenient to wash or prepare in advance the separate water bottle or container, he or she usually purchases a beverage product directly in the market and carries the beverage product itself. In the case of food, he or she usually carries the food in a state of putting it in the separate container.

That is, when a person goes to picnic or out in the countryside, he or she usually carries food and a beverage in a state of being put in separate containers.

Also, it has been frequently found that people eat instant food and drink according to need while wandering around the street. In this case, there is inconvenience in that people should put the food and drink in individual containers, or should individually carry the food and drink in an original product state.

As such, in addition to the inconvenience generated at the time of carrying and keeping the food and drink in a state of being put in individual containers, or carrying the food and drink individually, since people should use both hands when eating the food, it is very inconvenient for people to eat or drink the food or the beverage.

Also, there is inconvenience in that people should carry an assistive utensil such as chopsticks and the like in order to eat the food, and since the used assistive utensil such as chopsticks is discarded, waste is generated, thereby causing a problem such as environmental pollution.

In consideration of this problem, Korean Utility Model No. 20-0315319 and Korean Utility Model No. 20-0314352 have suggested [a portable double container] configured so that food and a beverage can be accommodated in one container.

However, the portable double container has a structural problem that an inner case of the container is not completely closed, and also has disadvantages that an outer case is integrally formed in a double structure so as not to be disassembled and washed in spite of the fact that the outer case should be completely disassembled and should be then washed for reasons of sanitation of the container, and that beverages cannot be stored because airtightness of the inner case is not maintained.

In particular, in the case of Korean Utility Model No. 20-0314352, in order to store food, the food should be contained in a storage chamber of a container having a screw bar, so the container is not good for sanitation reasons, and there is a disadvantage that it is very cumbersome and inconvenient to extract the food using a separate stick or to lift and lower the food.

Furthermore, Korea Patent No. 10-0963159, Japanese Patent Laid-Open Publication No. Hei 11-278597 and Japanese Patent Laid-Open Publication No. 2001-186922 have also suggested a portable food storage means. However, it is disadvantageous in that convenience is reduced during use because these means can store only food, but cannot simultaneously store a beverage and the food.

DISCLOSURE

Technical Problem

Accordingly, the present invention has been made keeping in mind the above problems occurring in the prior art, and an object of the present invention is to provide a novel portable triple container in which two separate spaces are formed so as to enable food and beverages to be separately accommodated in the container, and which also enables the food to be extracted and consumed through a simple operation, thereby enabling the food and beverages to be simply and conveniently carried and stored during an outdoor activity, and the food to be extracted without using an additional utensil so as to be conveniently consumed.

Another object of the present invention is to provide a novel portable triple container which is configured such that an operation cap part arranged at the bottom of the container is selectively fixed so as to not only restrict the rotation structure of an inner case according to need but also to ensure that the container is airtight, thereby filling the whole interior of the container with a beverage such as water.

Technical Solution

In order to accomplish the above objects, the present invention provides a portable triple container having the following features.

The portable triple container may include: an outer case having screw parts at the top and bottom thereof; a middle case that is concentrically disposed inside the outer case, forms a beverage storage part between an inner wall of the outer case and the middle case, and has a bottom cap part coupled to the screw part of the outer case and formed at the bottom thereof, and two line-type spiral grooves continued along a length direction and formed on an inner circumferential surface thereof; an inner case that is concentrically disposed inside the middle case, forms a food storage part therein, has two line-type straight guide holes formed in parallel along a length direction at a wall thereof, and is formed to be rotatable on its axis while being inserted into a groove on an inner circumferential surface of the top of the middle case; an operation cap part that is screw-coupled to a bottom portion of the inner case so as to be rotatable along with the inner case, and has a projection inserted into a groove arranged at a bottom cap part of the middle case; a food support that is concentrically disposed inside the inner case, has a guide projection formed at both sides of an outer circumferential surface thereof and hanging on a spiral groove of the middle case by passing through the guide projection of the inner case, and is formed to be lifted and lowered while being guided along the spiral groove of the middle case upon rotation of the inner case so as to push up food; and a cap configured to close atop portion of the outer case, thereby enabling food and a beverage to be kept and carried together and enabling the food to be easily extracted and consumed.

Here, the cap may include: double walls composed of an outside wall connected to the top portion of the outer case having a distance therebetween and an inner wall connected to a top portion of the middle case; and an openable and closable lid configured to close the top portion of the outer case, wherein a top opening of the outside wall and the inner wall is covered by a shielding plate having a beverage outlet and downwardly inclined toward center.

Furthermore, the lid of the cap may include an sealing body integrally attached to the cap using a band serving as a hinge and configured to keep the container airtight by being formed on a bottom surface and closing an upper opening of the food storage part.

According to another embodiment of the present invention, the operation cap part may be vertically movably assembled using a space part formed between an inner bottom surface of the operation cap part and a bottom surface of the middle case, and coupled to the outside of the screw part located at the middle case via the projection when moving upward so that the operation cap part including the inner case can be entirely fixed, thereby enabling the container to be used as a beverage container by filling the whole interior of the container with a beverage such as water.

Advantageous Effects

According to the present invention, the portable triple container has the following advantages.

A first advantage of the portable trip container is that it is convenient for a user to carry and keep food and a beverage upon an outside activity because the food and beverage can be put in one container.

A second advantage of the portable trip container is that a user can easily remove food accommodated therein by only turning an operation cap part disposed at the bottom by hand so as to conveniently eat the food even without any utensil such as chopsticks.

A third advantage of the portable trip container is that the container is formed in a structure in which respective cases of the triple container can be easily separated and assembled such that anyone can easily wash it and foods and a beverages can be sanitarily stored.

A fourth advantage of the portable trip container is that a round thread is formed at double walls of an upper cap, respectively, thereby enabling the maintenance of airtightness and enabling ease in opening and closing, and thanks to an up-and-down double structure of the cap, it is convenient to eat or drink food or a beverage.

A fifth advantage of the portable trip container is that an operation cap part of the bottom of the container can be fastened and fixed to the middle case by pushing up it so that the whole interior of the container can be filled with a beverage such as water, thereby enabling the container to be conveniently used as a beverage container.

Accordingly, the portable triple container of the present invention can keep the same beverages or each of different beverages because the airtightness of an outer case and inner case is maintained, can maintain beverages warm or cold for a certain time using a portable insulating cover, can increase warmness and coldness of contents accommodated in the outer case or the inner case by putting a cold material or a hot material in one case of the outer case and the inner case, or can maintain warmness and coldness by putting contents in the inner case between an insulating cover and a closed space of the outer case.

MODE FOR INVENTION

Exemplary embodiments of the present invention will be described in detail with reference to the accompanying drawings as follows.

FIG. 1 through FIG. 5 are perspective views and enlargement views showing a portable triple container according to one exemplary embodiment of the present invention.

As illustrated in FIGS. 1 to 5, the portable triple container may carry food and a beverage in a state of putting the food in the center thereof and the beverage in the circumference thereof. Three cases having a cylindrical shape, are composed of, for example, an outer case 11 which forms a main body of the container, a middle case 15 concentrically disposed inside the outer case, and an inner case 20. A space formed between the outer case 11 and the middle case 15 is filled with a beverage such as water, and food such as "giMbab" is accommodated inside the inner case 20.

The outer case 11 is a part which constitutes a body of the portable triple container and has screw parts 10*a*, 10*b* formed at the top and the bottom thereof, respectively. the top screw part 10*a* is coupled to a cap 24 which will be described later, and the bottom screw portion 10*b* is coupled to the screw portion 10*c* arranged at the middle case 15.

The outer case 11 may be made of a material such as plastic or stainless steel. The screw parts 10*a*, 10*b* provided with the outer case 11 may be provided in a round thread form having a thread formed at the inside and outside or at one side.

Figure 1:
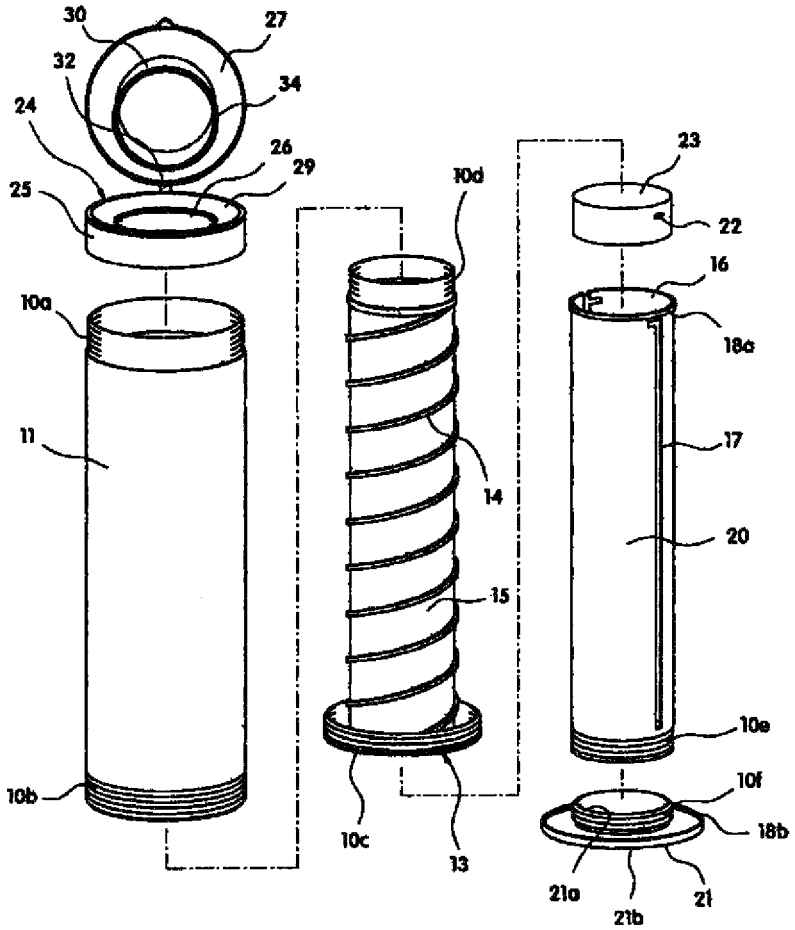
FIG. 1 is a disassembled perspective view showing a portable triple container according to one exemplary embodiment of the present invention.
Figure 2:
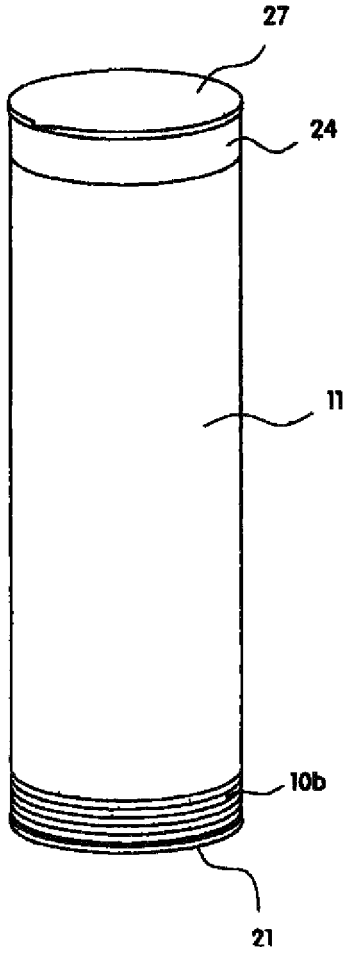
FIG. 2 is an assembled perspective view showing the portable triple container according to the one exemplary embodiment.
Figure 3:
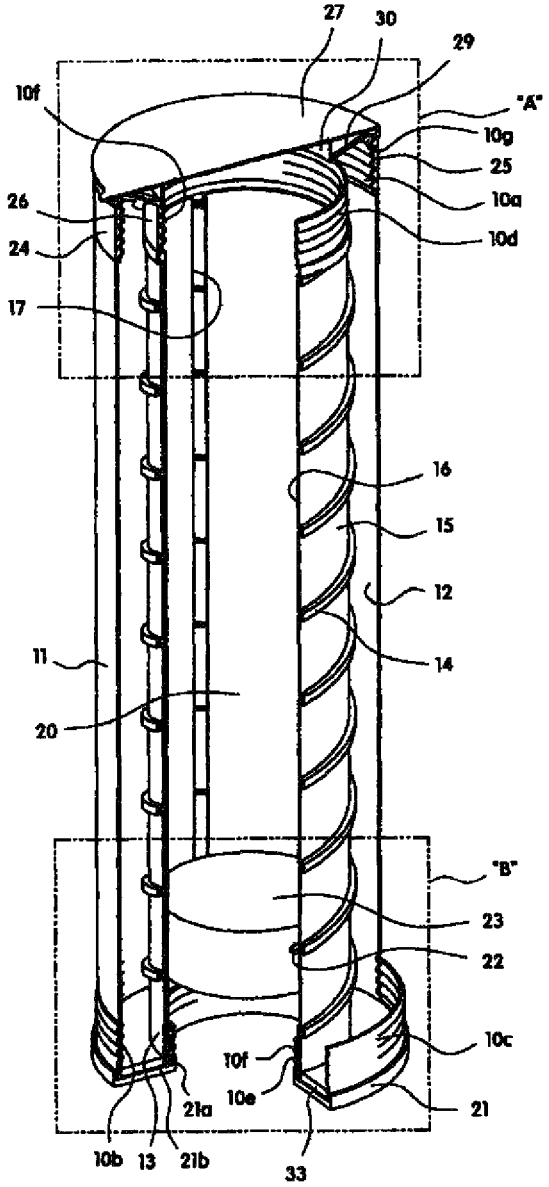
FIG. 3 is a sectional perspective view showing the portable triple container according to the one exemplary embodiment.
Figure 4:
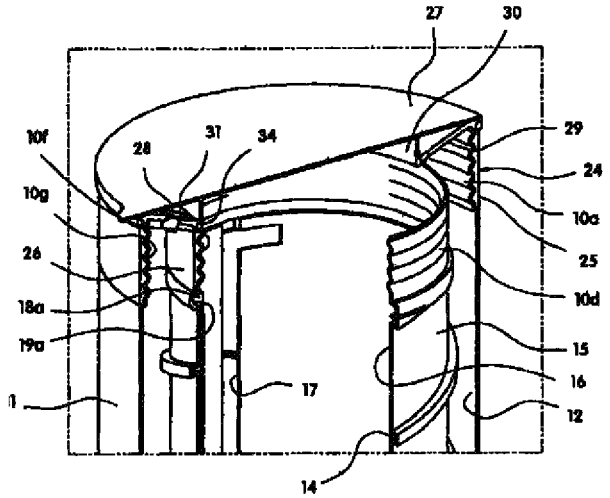
FIG. 4 is an enlargement view of part "A" of FIG. 3.
Figure 5:
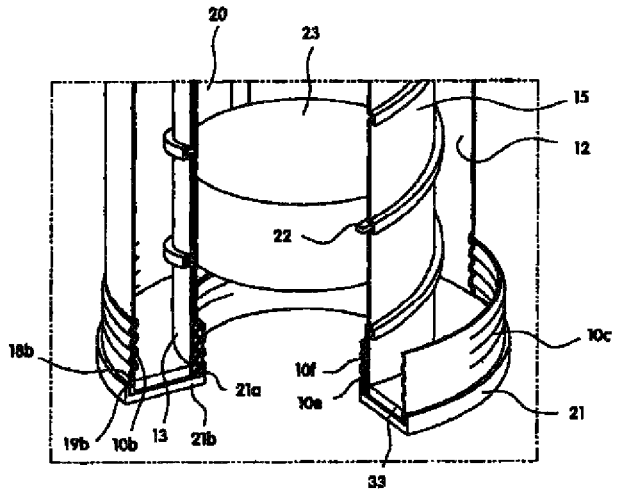
FIG. 5 is an enlargement view of part "B" of FIG. 3.

Meanwhile, as illustrated in FIG. 2, an insulating cover 35 made of cloth may be provided as a means for keeping the warmth of a food and a beverage, and the insulating cover may have a shape which entirely surrounds the outer case 11 and may perform a heat reserving and insulating function.

Of course, it is preferable that an opening and closing means such as an up-down zipper 36 be provided in a cover so that the cover can be easily opened and closed.

The middle case 15 is concentrically disposed inside the outer case 11 and is a part which forms a beverage storage part 12 between an inner wall of the outer case and the middle case, and a bottom cap 13 having a relatively large diameter than that of the middle case 15 formed in a bottom portion of the middle case, and a screw part 10*c* coupled to a screw part 10*b* of the outer case 11 is formed in the bottom cap 13.

Thus, the middle case 15 may be integrally connected to the outer case 11 while being coupled to the outside of the screw part 10*b* arranged at the bottom portion of the outer case 11 via the screw part 10*c* of the bottom cap 13.

Also, a screw part 10*d* is also formed at a top portion of the middle case 15 so that the middle case can be coupled to the cap 24, which will be described later, via the screw part 10*d*.

Furthermore, a groove 19*b* is provided on the circumference of a bottom end of the bottom cap 13, and a projection

18*b* arranged at an operation cap part 21, which will be described later, may be inserted into and caught in the groove 19*b*.

Also, in an inner circumferential surface of the top portion of the middle case 15, a groove 19*a* may be provided at a position just below the screw part 10*d*, and a projection 18*a* arranged at the inner case 19*a* may be inserted into and caught in the groove 19*a*.

Also, a packing 33 is attached to an inner bottom of the bottom cap part 13 arranged at the middle case 15, and the packing 33 functions to keep the beverage storage part 12 filled with a beverage airtight.

Here, the packing 33 may be formed in a thin ring-like shape having a predetermined thickness and may apply a seal means made of an elastic material coated on the bottom surface of the cap part or may keep an airtight seal using elasticity of a material itself by forming the bottom cap part 13 itself with the elastic material.

The middle case 15 may be also made of a plastic or stainless steel material, etc., and the screw parts 10*c*, 10*d* provided at the middle case 15 may be provided in a round thread form having a thread formed in the inside and outside thereof or one side thereof.

In particular, the middle case 15 includes two strings of spiral grooves 14 as an element for inducing the lifting and lowering of a food support 23 which pushes up food.

The two strings of spiral grooves 14 are formed in parallel along a length direction of the middle case from an inner circumferential surface of the middle case 15, and each of the spiral grooves 14 is disposed in a symmetric structure which leads to the length direction along the inner circumferential surface of the middle case while having a 180° phase difference between the spiral grooves.

That is, one line type spiral groove 14 leads to the top in a spiral shape along the inner circumferential surface of the middle case from the bottom of the middle case 15, and the other line type spiral groove 14 leads to the top in a spiral shape along the inner circumferential surface of the middle case from the bottom on an opposite side of the middle case 15 which is apart from a starting position of the spiral grooves 14 at 180°.

At this time, the two strings of spiral grooves 14 have the same spiral angle so that the food support 23 can perform an upward and downward movement while stably forming a horizontal position.

The inner case 20 is an element configured to provide a space capable of putting food therein, namely, a food storage part 16, and to provide power for lifting and lowering of the food support 23 while rotating on the spot with a self axial line as its center, and is concentrically disposed inside the middle case 15.

The projection 18*a* is formed around an outer circumferential surface of the top portion of the inner case 20 so as to be inserted into a groove 19*a* formed on the inner circumferential surface of the middle case 15.

In particular, two straight lines of guide holes 17 continuously connected along a length direction of the inner case while passing through a wall of the inner case are formed in the inner case 20. A guide projection 22 arranged at the food support (23) may pass through the straight guide holes 17, and an end portion of the guide projection 22 may be located to extend to the outside of the inner case.

The straight guide holes 17 may be also configured in a form in which they are disposed in parallel to each other while having a 180° phase difference therebetween, and each of the straight guide holes 17 is enclosed while having a horizontal section at a top end and a bottom end. At least one side of the top end of the straight guide holes 17 may be open toward the top of the case.

As such, since the straight guide holes 17 is configured in a form in which one side of the top end is open, when the inner case 20 is assembled to the inside of the middle case 15, the top of the case may be slightly pursed so that assembly can be easily performed, and may be restored to its original state after assembly has been completed.

Furthermore, a screw part 10*e* is formed around an outer circumferential surface of the bottom portion of the inner case 20, The operation cap part 21, which will be described later, is coupled to the screw part 10*e* in a coupling structure so that the inner case 20 and the operation cap part 21 are integrally movable.

Also, the operation cap part 21 is formed as an operating means for turning the inner case 20.

The operation cap part 21 is an element which is rotated with the inner case 20 in a state of being coupled to a bottom portion of the inner case 20 in a screw-coupled structure. The operation cap part 21 has a similar diameter to the bottom cap part 13 arranged at the middle case 15, and a screw part 100 coupled to the bottom screw part 10*e* of the inner case 20 is provided on the inner circumferential surface of a cylindrical body 21*a*, and the projection 18*b* inserted into the groove 19*b* arranged at the bottom cap part 13 of the middle case 15 is provided in an inner circumference of a disk type cap 21*b*.

Thus, the operating cap part 21 and the inner case 20 are coupled to each other via the screw parts 10*e*, 10*f* possessed thereby and are integrally assembled, and are inserted into the groove 19*a* arranged at the top of the middle container 15 and the groove 19*b* arranged at the bottom of the bottom cap part, respectively using the projection 18*a* arranged at the inner case 20 and the projection 18*b* arranged at the operation cap part 21, so the operating cap part 21 and the inner case 20 can be rotated on their axes while being supported to the middle case 15 depending on a coupling structure between the up and down projections and grooves.

Here, the coupling structure between the up and down projections and grooves means a structure in which the projections may be easily inserted into or extracted from the grooves when the user applies his or her power to a degree thereto. When assembling, the projections may be forcibly pressed on and inserted into the grooves, and when disassembling according to the need such as washing, the projections may be easily separated from the grooves by drawing the projections out of the grooves with the application of a little gentle force.

The food support 23 is an element configured to push up food accommodated in the food storage part 16 of the inner case 20 so that a user can easily pull the food out of the food storage 16 and can eat it, and is formed in a cylindrical shape having the guide projection 22 at both sides of an outer circumferential surface thereof.

The food support 23 is concentrically disposed inside the inner case, namely, inside the food storage part 16. The guide projection 22 formed at both sides of the outer circumferential surface of the food support is inserted into the spiral groove 14 of the middle case 15 while passing through the guide holes 17 of the inner case 20.

Thus, when the inner case is rotated by turning the operation cap part 21, the food support 23 receives tension upward and downward due to a pushing force of the straight guide holes 17 of the inner case 20 (interference between the guide holes and the guide projection resulting from a turning force of the inner case). Eventually, the food support 23 is lifted or lowered while being guided along the thread 14 of the middle case 15 so as to push up the food or push it back into place.

Meanwhile, in the present invention, the cap 24 is provided as a means for closing the triple container in which the food and a beverage are accommodated together.

The cap 24 efficiently covers upper portions of the outer case 11 and the middle case 15 doubly formed for keeping a beverage at the same time as covering an upper portion of the inner case 20 in which food is accommodated.

To do so, the cap has a cylindrical-shaped inner wall 26 and outside wall 25 having a distance therebetween (a distance correspond to about the beverage storage part), the outside wall 25 is coupled to the top screw part 10*a* of the outer case 11, and the inner wall 26 is screw-coupled to the top screw part 10*d* of the middle case 15 so that the outer case 11, the middle case 15 and the cap can be integrally assembled.

For example, screw parts 10*f*, 10*g* formed in a round thread form are provided in the inner wall 26 and the outside wall 25, respectively. The screw parts 10*f*, 10*g* are fastened to the screw part 10*a* of the outer case 11 and the screw part 10*d* of the middle case 15 together so that the outer space of a double container structure can be efficiently maintained airtight.

Furthermore, a top opening of the outside wall 25 and the inner wall possessed by the cap 24 is covered by an shielding plate 29 downwardly inclined toward the center, and a food outlet 28 covered by an openable and closable lid 31 is formed at one side of the shielding plate 29.

As such, as the shielding plate 29 is configured in an inclined shape, when a user pours a beverage by tilting the triple container, the beverage can flow naturally and can be then discharged.

As a result, the upper portion of the food storage part 12 formed between the outer case 11 and the middle case 15 is closed by the shielding plate 29 with assembly of the cap 27 so as to be stably closed without outside exposure.

Also, an upper portion of the cap 27 is covered by the openable and closable lid 27, and the lid 28 is formed in a disk form. A band 32 capable of serving as a hinge is integrally formed at one side of an edge of a plate body of the lid, and at the same time, the band 32 is also integrally connected to the cap 24 so as to perform a hinge function when the lid 27 is opened and closed.

Furthermore, a sealing body 30 inserted into the inside of the top of the middle case 15 and configured to keep airtightness is formed in the center of a bottom surface of the lid 27.

Here, a sealing projection 34 inserted into a groove portion of an upper inner circumference of the cap 27 is formed in a lower circumferential portion of the sealing body 30 so that the upper portion of the food storage part 17 can be covered by the sealing body 30, which is preferable in terms of keeping warmth and airtightness.

Accordingly, a use state of the triple container configured as such is reviewed as follow.

Figure 6:
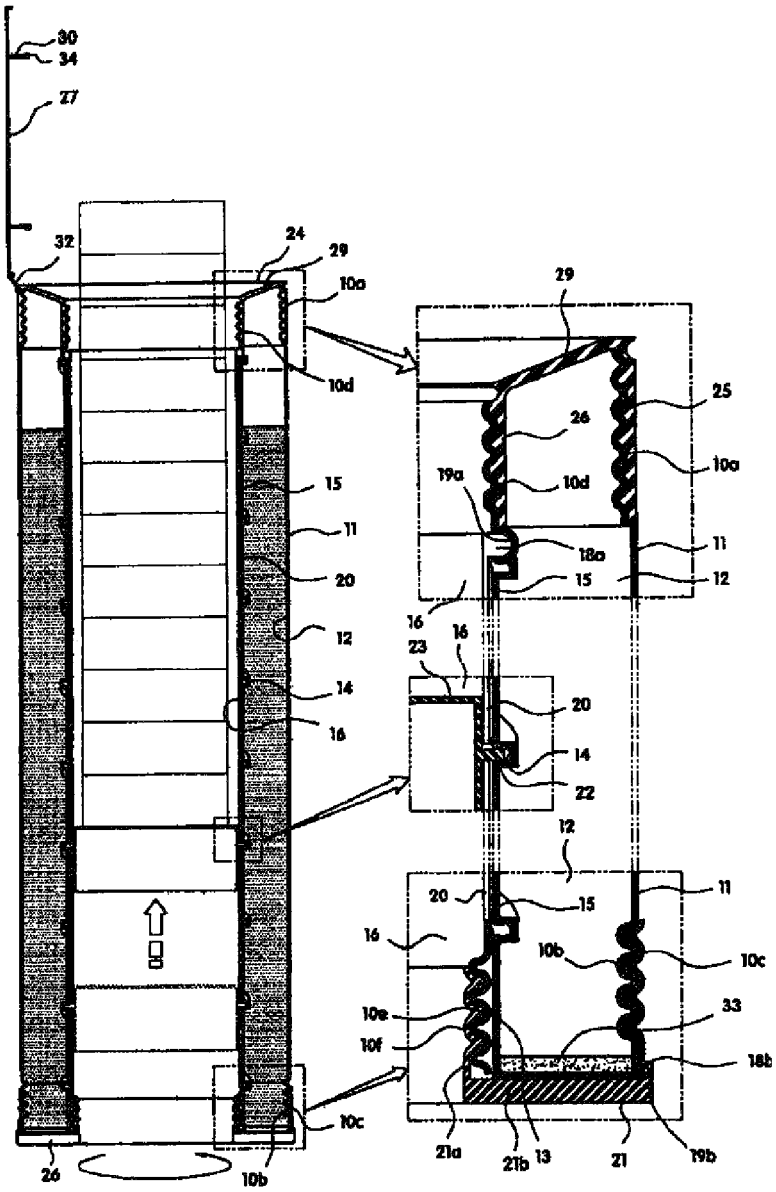
FIG. 6 is a cross-sectional view showing a use state of the portable triple container according to the one exemplary embodiment.

FIG. 6 is a cross-sectional view showing the use state of a portable triple container according to yet another exemplary embodiment.

As illustrated in FIG. 6, the food storage part 16 formed inside the inner case 20 of the portable triple container is filled with a food 100 such as "gimbab" and the like, and the beverage storage part 12 formed between the outer case 11 and the middle case 15 is filled with a beverage 110 such as water and the like.

Furthermore, the food support 23 installed inside the food storage part 16 is located at the lowermost portion of the food storage part so that the food storage part 16 can be filled with food.

In order to eat the food in this state, as a user opens the lid 27 covering the cap 24 and pushes it to one side, and then rotates the inner case while turning the operation cap part 21 by hand, the food support 23 is moved upward with guidance of the spiral groove 14 so that the food can be pushed up by the food support 23, thereby enabling the food extracted from the outside to be easily consumed.

That is, the food may be extracted by appropriately turning only the operation cap part 21, thereby enabling the food to be conveniently consumed even without a separate utensil such as chopsticks and the like.

Furthermore, in the case of a beverage, the user may easily drink it while opening the cover 31 of the cap 24 and tilting the container.

Meanwhile, the present invention also provides the portable triple container which can be used in a state of being entirely filled with a beverage such as water except for a purpose for putting food and water therein.

Figure 7:
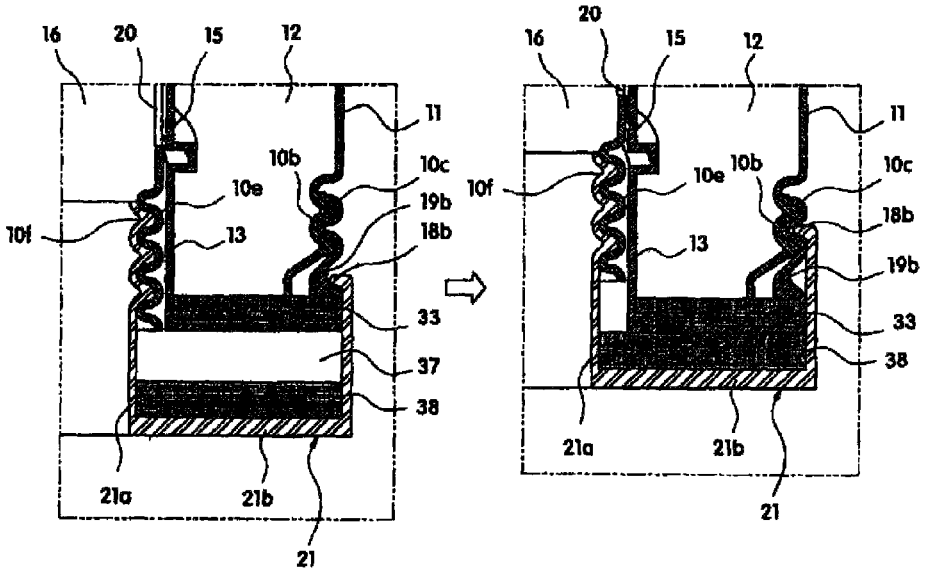
FIG. 7 is a sectional perspective view showing a portable triple container according to another exemplary embodiment.

For this, as illustrated in FIG. 7, the operation cap part 21 mounted to the bottom portion of the container, namely, the operation cap part 21 which hangs on the middle case 15 in a locking structure while being screw-coupled to the inner case 20, is vertically movably assembled in a section corresponding to an about 1 to 2 pitch screw.

For the vertical movement of the operation cap part 21, a space part 37 for providing the operation cap part with a movable margin is formed between the inner bottom surface of the operating cap 21 and the bottom surface of the middle case 12, the projection 18*b* of the operation cap part 21 is vertically movably located within the groove 19*b* arranged at the bottom cap part 13 of the middle case 15.

Here, the bottom portion of the outer case 11 has a shape having a reduced diameter in a certain length toward the inside. In addition to this, the bottom cap part 13 located at the middle case 15 also has a shape reduced in diameter in a certain length of the bottom portion, for example, in a certain length of a part where the groove 19*b* is formed toward the inside.

Thus, when using the container in a state of putting food and water together therein as usual, the operation cap part 21 can perform a normal rotation operation, and when using the container in a state of filling the whole interior of the container with water, the operation cap part 21 can be pushed up and fixed.

For example, when the projection 18*b* is coupled to the outside of the screw part 10*c* arranged at the middle case 15 by pushing up the operation cap part 21 which has been located downward, that is, when the projection 18*b* is coupled to screw part 10*c* by slightly shifting the operation cap part 21 in a screw-coupling direction while pushing up, the operation cap part 21 may be fixed to the middle case 15, and as a result, the operation cap part 21 and the inner case 20 may be entirely immovably fixed.

At this time, it is preferable that the projection 18*b* located at the operation cap part 21 be configured in a projection form which is formed while spirally turning so as to be easily coupled to or pulled out of the screw part 10*c* of the middle case.

Of course, in order to enable the inner case 20 to slightly go up along with the operation cap part 21, an upper and lower width of the groove 19*a* of the middle case into which the projection 18*b* located at the top portion of the inner case 20 is inserted are slightly widely formed, and thus when the inner case 20 is moved upward, the projection 18*b* is also moved up within the groove 19*a*, thereby enabling the inner case 20 to be moved without any problem.

Furthermore, the sealing pad 38 is mounted in the space part 37 formed between the inner bottom surface of the operation cap part 21 and the bottom surface of the middle case 15, and accordingly, the operation cap part 21 is coupled to the middle case 15, and at the same time, the sealing pad 38 is pressed on a bottom surface of the bottom cap part 13, thereby enabling airtightness of the container to be secured.

Meanwhile, when the operation cap part 21 fixed to the middle case 15 is loosened by turning it in reverse, the operation cap part 21 is returned to its original bottom position, thereby enabling the container to be used as a container for putting food again.

As such, it is advantageous in that it is convenient for the container to carry and keep the food and beverage during an outdoor activity because the food and beverage can be accommodated in one container together, and that the food can be also easily pushed up and consumed and the outer case, the middle case the inner case, the operation cap part and the like of the triple container can be easily separated to be convenient to wash.

Furthermore, it is advantageous in that water can be added into a space filled with food because the operation cap part located at the bottom of the container may be selectively fixed, thereby increasing availability of the container.

<Description of the Reference Numerals in the Drawings>

| | |
|---|---|
| 10a, 10b, 10c, 10d, 10e, 10f, 10g: Screw parts | |
| 11: Outer case | |
| 12: Beverage storage part | 13: Bottom cap part |
| 14: Spiral groove | 15: Middle case |
| 16: Food storage part | 17: Straight guide |
| 18a, 18b: Projections | 19a, 19b: Grooves |
| 20: Inner case | 21: Operation cap part |
| 21a: Cylindrical body | 21b: Disk type cap |
| 22: Guide projection | 23: Food support |
| 24: Cap | 25: Outer wall |
| 26: Inner wall | 27: Lid |
| 28: Beverage outlet | 29: Shielding plate |
| 30: Sealing body | 31: Cover |
| 32: Band | 33: Packing |
| 34: Sealing projection | 35: Insulating cover |
| 36: Zipper | 37: Space part |
| 38: Sealing pad | |

INDUSTRIAL APPLICABILITY

Under the circumstance that most of food and beverages have been packaged using separate containers, the portable triple container is divided into upper and lower parts in order to keep food and a beverage in one container. Accordingly, the container can simultaneously keep foods and beverages, and it does not need a separate utensil for eating and also does not need fuel, water and the like for cooking outdoors. Thus, if the container is produced in a disposable form, it can be sold through a vending machine, and thus, the container will be effective in developing new markets in the food and beverage industry in a take-out form for outdoor lunch for hungry people, combat ration for servicepersons, various exhibitions. Also, as if there is the industry of various franchise forms using ice cream, the container can be used in the food and beverage franchise industry by developing various food products and beverages using the container.

The invention claimed is:

1. A portable triple container, comprising:

an outer case (11) having screw parts (10*a*, 10*b*) at the top and bottom thereof;

a middle case (15) concentrically disposed inside the outer case (11), configured to form a beverage storage part (12) between an inner wall of the outer case and the middle case, and having a bottom cap part (13) including a screw part (10*c*) coupled to the screw part (10*b*) of the outer case (11) and formed at the bottom thereof, and two strings of spiral grooves (14) continued along a length direction and formed on an inner circumferential surface thereof;

an inner case (20) concentrically disposed inside the middle case (15), configured to form a food storage part (16) therein, having two straight lines of guide holes (17) formed in parallel along a length direction at a wall thereof, and formed to be rotatable on its axis while being inserted into a groove (19*a*) on an inner circumferential surface of the top of the middle case (15);

an operation cap part (21) screw-coupled to a bottom portion of the inner case (20) so as to be rotatable along with the inner case (20), and having a projection (18*b*) inserted into a groove (19*b*) located at a bottom cap part (13) of the middle case (15);

a food support (23) concentrically disposed inside the inner case (20), having a guide projection (22) formed at both sides of an outer circumferential surface thereof and hanging on a spiral groove (14) of the middle by passing through the guide projection (17) of the inner case (20), and formed to be lifted and lowered while being guided along the spiral groove (14) of the middle case (15) upon rotation of the middle case (10) so as to push up food; and a cap (24) configured to close a top portion of the outer case (11).

2. The portable triple container of claim 1, wherein the cap (24) comprises: double walls composed of an outside wall (25) connected to the top portion of the outer case (11) having a distance therebetween and an inner wall (26) connected to a top portion of the middle case (15); and an openable and closable lid (27) configured to close the top portion of the outer case, wherein a top opening of the outside wall (25) and the inner wall (26) is covered by a shielding plate (29) having a beverage outlet (28) and downwardly inclined toward center.

3. The portable triple container of claim 1, wherein a lid (27) of the cap (24) comprises a sealing body (30) attached to the cap (24) using a band (32) serving as a hinge and configured to keep airtightness by being formed on a bottom surface and closing an upper opening of the food storage part (16).

4. The portable triple container of claim 1, wherein two strings of spiral grooves (14) formed in the middle case (15) are disposed in a symmetric structure leading to a length direction along the inner circumferential surface of the middle case while having a 180° phase difference.

5. The portable triple container of claim 1, wherein the cap (24) has an inner wall (26) and an outside wall (25) in a cylindrical shape having a distance therebetween, wherein screw parts (10*f*, 10*g*) are provided at the inner wall (26) and the outside wall (25), respectively, so as to be simultaneously coupled to the screw part (10*a*) of the outer case (11) and the screw part (10*d*) of the middle case (15).

6. The portable triple container of claim 1, wherein the outer case (1) is enveloped by an openable and closable insulating cover so as to be heat retained and insulated.

7. A portable triple container, comprising:

an outer case (11) having screw parts (10*a*, 10*b*) at the top and bottom thereof;

a middle case (15) concentrically disposed inside the outer case (11), configured to form a beverage storage part (12) between an inner wall of the outer case and the middle case, and having a bottom cap part (13) formed at the bottom thereof and including a screw part (10*c*) coupled to the screw part (10*b*) of the outer case (11), and two strings of spiral grooves (14);

an inner case (20) concentrically disposed inside the middle case (15), configured to form a food storage part (16) therein, having two straight lines of guide holes (17) formed in parallel along a length direction at a wall thereof, and formed to be rotatable on its axis while being inserted into a groove (19*a*) on an inner circumferential surface of the top of the middle case (15);

an operation cap part (21) screw-coupled to a bottom portion of the inner case (20) so as to be rotatable along with the inner case (20), and having a projection (18*b*) inserted into a groove (19*b*) located at a bottom cap part (13) of the middle case (15);

a food support (23) concentrically disposed inside the inner case (20), having a guide projection (22) formed at both sides of an outer circumferential surface thereof and hanging on the spiral grooves (14) of the middle case by passing through the guide projection (17) of the inner case (20), and formed to be lifted and lowered while being guided along the spiral grooves (14) of the middle case (15) upon rotation of the inner case (10) so as to push up food; and a cap (24) configured to close a top portion of the outer case (11), wherein the operation cap part (21) is vertically movably assembled using a space part (37) formed between an inner bottom surface of the operation cap part and a bottom surface of the middle case (15), and coupled to the outside of the screw part (10*c*) located at the middle case (15) via the projection (18*b*) when moving upward so that the operation cap part (21) including the inner case (20) can be entirely fixed.

8. The portable triple container of claim 7, wherein a sealing pad (38) is mounted in the space part (37) formed between the inner bottom surface of the operation cap part (21) and the bottom surface of the middle case (15).

9. The portable triple container of claim 2, wherein the lid (27) of the cap (24) comprises a sealing body (30) attached to the cap (24) using a band (32) serving as a hinge and configured to keep airtightness by being formed on a bottom surface and closing an upper opening of the food storage part (16).

10. The portable triple container of claim 2, wherein two strings of spiral grooves (14) formed in the middle case (15) are disposed in a symmetric structure leading to a length direction along the inner circumferential surface of the middle case while having a 180° phase difference.

* * * * *